United States Patent [19]

Küper

[11] 4,288,932

[45] Sep. 15, 1981

[54] SNOW REMOVAL BAR FOR THE SNOW REMOVAL PLATE OF A SNOW PLOW

[76] Inventor: Walter Küper, Am Varenholt 56,, 4630 Bochum-Stiepel, Fed. Rep. of Germany

[21] Appl. No.: 115,832

[22] Filed: Jan. 28, 1980

[30] Foreign Application Priority Data

Feb. 2, 1979 [DE] Fed. Rep. of Germany ..... 2904251

[51] Int. Cl.[3] ..... E01H 5/06

[52] U.S. Cl. ..... 37/42 VL

[58] Field of Search ..... 37/41, 42 R, 42 VL, 37/50, 53, 142 A; 172/767, 801

[56] References Cited

U.S. PATENT DOCUMENTS

| | | | |
|---|---|---|---|
| 3,413,738 | 12/1968 | Goldberg | 37/42 VL |
| 3,466,766 | 9/1969 | Kahlbacher | 37/42 VL X |
| 3,477,149 | 11/1969 | Wagner | 37/42 VL |

FOREIGN PATENT DOCUMENTS

| | | | |
|---|---|---|---|
| 729862 | 3/1966 | Canada | 37/142 A |
| 2900904 | 7/1979 | Fed. Rep. of Germany | 37/42 VL |
| 1255480 | 1/1961 | France | 37/42 VL |
| 1058602 | 2/1967 | United Kingdom | 37/42 VL |

*Primary Examiner*—E. H. Eickholt

*Attorney, Agent, or Firm*—Allison C. Collard; Thomas M. Galgano

[57] ABSTRACT

A snow removal bar for the snow removal plate of a snow removal plow consists of a rubber or plastic element which is reinforced with steel plates on both sides thereof, and which has an upper edge mounted on the lower edge of the snow removal plate with screws. Only the lower area of the rubber or plastic element, which comes into contact with the road, is reinforced by the steel plates and the center area thereabove is reinforced by elastic reinforcements. The reinforcements are embedded in the rubber or plastic element and extend from the upper edge of the plastic or rubber element to the area between the steel plates.

6 Claims, 1 Drawing Figure

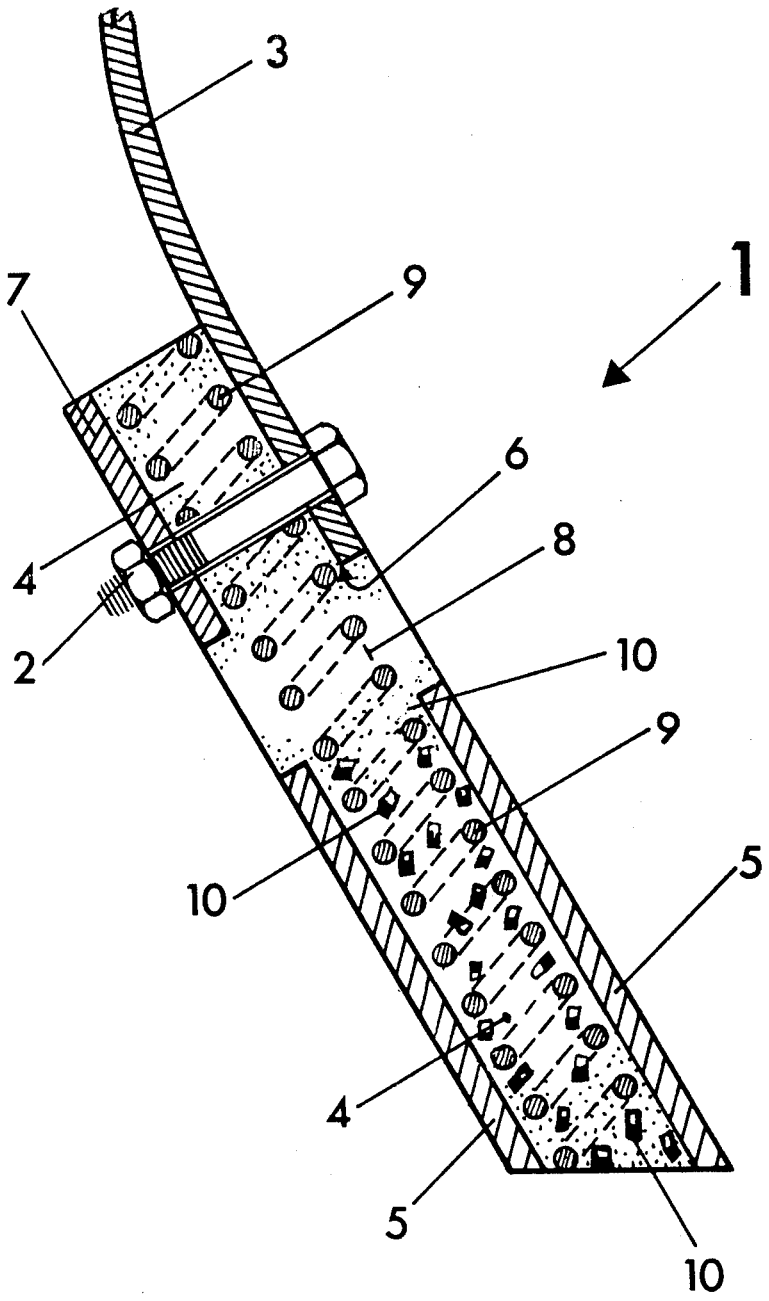
3
1
7
9
6
8
4
2
10
9
10
5
4
5
10

SNOW REMOVAL BAR FOR THE SNOW REMOVAL PLATE OF A SNOW PLOW

The invention relates to a snow removal bar for the snow removal plate of a snow removal plow. More particularly, it relates to such a snow removal bar consisting of a rubber or plastic element which is reinforced with steel plates on both sides thereof and which has an upper edge which is mounted on the lower edge of the snow removal plate with screws.

In accordance with the state of the art (German Petty patent No. 77 02 414), snow removal bars of the above-mentioned type are known wherein the total surface of the rubber or plastic elements, i.e., both the front as well as the rear face thereof, is covered by steel plates which extend across the entire width of the snow removal bar. Such snow removal bars are able, in view of their sandwich structure (i.e., steel-rubber-steel), to remove ice or compacted snow from the road surface and still have a good wear and tear resistance, because the rubber or plastic, which is covered on both sides, is protected against mechanical damage caused by sharp edged obstacles which may be present in and/or on the street surface. Hence, the rubber or plastic material is only subjected to normal abrasion, which abrasion level is lower in rubber or plastic, than in steel.

However, the known snow removal bars of the aforementioned type are disadvantageous in that they are too stiff due to the covering steel plates, so that they act like a rigid extension of the snow removal plate which cannot pass rigid obstacles in and/or on the street surface. For this reason, vehicles which are provided with such snow removal bars must move slowly, so as to prevent damage to the snow removal plate on the snow plow and/or to the street surface.

It is therefore an object of the invention to improve the snow removal bar of the aforementioned type in such a manner that it can pass rigid obstacles in and/or on the street surface. This enables higher driving speeds for the snow removal vehicles.

This object of the invention is attained in accordance with the present invention by the provision of a snow removal bar of the aforementioned type wherein only the lower area of the rubber or plastic element, which comes into contact with the road, is reinforced by steel plates, and the center area thereabove is reinforced by elastic reinforcement elements which are embedded in the rubber or plastic element and which extend from the upper edge of the plastic or rubber element to the area between the steel plates.

In accordance with the inventive snow removal bar, the center area which is left free of the steel plates forms a bending joint between the upper edge which is used for the screw or bolt mounting and the area which is reinforced with the steel plates and which comes into contact with the street surface. The area which is disposed in the center, i.e., the unreinforced rubber and plastic element, is not, by itself, in a position to absorb the large bending forces which would be able to tear the rubber or plastic material in the area of the bending joint or to tear this material off the adjacent steel portions or the rigid remaining sections. For this reason, the subject invention provides a further reinforcement in the bending joint by embedding a further elastic reinforcement into the rubber or plastic element, extending from the upper edge of the snow removal bar into the area between the steel plates. This additional elastic reinforcement provides the required stiffness for the bending joint. Due to the fact that the elastic reinforcement extends from the upper edge of the rubber or plastic element and into the area between the steel plates, a portion of the bending forces is absorbed directly by the elastic reinforcement, without stressing the rubber or plastic material mass. In this manner, damage to the rubber or plastic element in the area of the bending joint is prevented.

Preferably, the elastic reinforcements are stationarily-affixed helical springs. Such rigid helical springs bond very well with the rubber or plastic material in which they are embedded and, in addition, have strong progressive spring characteristics during bending stress, which is of particular importance for reinforcing the above-explained bending joint. When using helical springs as the elastic reinforcement elements, the lower area of the snow removal bar can easily pass by smaller obstacles in the street surface without exerting large bending forces. When larger obstacles are present, which generally are stiff, hard, frozen ice or snow bulges, larger bending forces have to be applied so that such bulges are removed. Despite this fact, the snow removal bar can pass over the larger rigid obstacles which cannot be removed.

In a particular preferred embodiment of the invention, elements made of a hard material, in particular, made of hard metal or corundum are embedded in the rubber or plastic element in the area between the plates. Such hard materials which are embedded in the rubber or plastic material may have a grain size range of 0.5 to 3 cm, and they influence the wear and tear and the sliding behavior of the snow removal bar rather favorably. These hard materials which are used in the snow removal bar have the slowest wear and tear characteristic of all the other materials used, so that they extend, after a certain time of operation, in the form of round bulges from the rubber or plastic mass. These hard material bulges slide easily on the street surface due to their inherent hardness and they also carry a large part of the weight of the snow removal plate at a rather low drive resistance; this drive resistance is considerably lower than the drive resistance of the rubber or plastic material, per se, sliding on the street surface. In view of the fact that the very hard but also brittle elements are embedded in the rubber or plastic material, they are able to absorb suddenly occurring shocks which would result in destruction of non-elastic hard elements. The steel plates which are provided on both sides prevent the embedded hard elements from being pushed transversely out of their rubber or plastic embedment.

The embedment of hard elements is very advantageous even without the aforementioned bending joint between the lower portion and the mounting portion of the snow removal bar. However, the snow removal bar is particularly advantageous in conjunction with the aforementioned bending joint. On the one hand, the bending element shields the hard elements from strong forces which could tear the hard elements free from their embedment. On the other hand, due to the lower drive resistance, the bending forces which have to be absorbed by the bending element are considerably lower. Therefore, the cooperation of the hard elements with the bending joint permit considerably higher driving speeds of the snow removal vehicle, which is important in view of the throwing distance and the kilometer capacity. The reduction of the drive resistance also reduces the gas consumption considerably.

In a further advantageous embodiment of the invention, a recess is provided in the upper edge of the snow removal bar for receiving the lower edge of the snow removal plate and, on the opposite upper edge, a support plate is provided for supporting the nuts or screw (or bolt) heads of the screw (or bolt) coupling. This embodiment of the snow removal bar assures a particularly safe and robust mounting of the snow removal plate, which is a prerequisite for an efficient operation of the above-mentioned bending joint. Furthermore, the suggested recess provides a smooth transmission between the snow removal bar and the removal plate, so that the throw parabola for the removed snow is not interferred with.

Other objects and features of the present invention will become apparent from the following detailed description, considered in connection with the accompanying drawing, which discloses a single embodiment of the invention. It is to be understood, however, that the drawing is designed for the purpose of illustration only, and not as a definition of the limits of the invention.

In the drawing, a vertical sectional view through a snow removal bar embodying the present invention is shown, as well as the lower area of the snow removal plate of a snow plow.

Referring now in detail to the drawing, a snow removal bar 1 is shown which is mounted by means of screw or bolt assemblies 2 onto the lower edge of a snow plate 3 of a snow plow. Snow removal bar 1 is provided with an element 4 made of a wear-resistant rubber or plastic material. The lower area of rubber or plastic element 4 is reinforced by means of steel plates which brace both surfaces of the snow removal bar 1 and which extend across the entire width of snow removal bar 1. Steel plates 5 extend upwardly to a point as far up as the snow removal bar 1 should be used during operation; i.e., covering the portion of bar 1 that comes into contact with the ground.

A recess 6 is provided in the area of the upper edge 1 which receives the lower edge of snow removal plate 3. Opposite of recess 6, a support plate 7 is provided which acts to support the nut and bolt assemblies 2.

An elastic area 8 of element 4 remains between the area reinforced by steel plates 5 and the upper edge which serves to mount snow removal bar 1. This elastic area 8 is reinforced by elastic reinforcement inserts in the form of helical springs 9 which are embedded in the rubber or plastic material. These helical springs 9 extend from the upper edge of snow removal bar 1 at least to and between the steel plates 5; in the shown embodiment they, in fact, extend up to the lower edge of the snow removal bar 1. These helical springs 9 absorb a large part of the bending forces which is exerted on the elastic area 8 and they have strong progressive spring characteristics.

Hard elements 10 are embedded between the steel plates in the rubber or plastic mass of element 4. These hard elements 10 consist, for example, of hard metal or corundum granules having a grain size of 0.5–3 cm.

While only a single embodiment of the present invention has been shown and described, it will be obvious that many modifications and changes may be made thereunto, without departing from the spirit and scope of the invention.

What is claimed is:

1. A snow removal bar for the snow removal plate of a snow removal plow of the type including a rubber or plastic element which is reinforced with steel plates disposed on both sides thereof and which has an upper edge which is mounted on the lower edge of the snow removal plate with bolts, the improvement comprising:

said element being reinforced by steel plates disposed on both sides thereof only in the lower portion of said element which comes into contact with the road, said element also having a central portion disposed above said lower portion which is reinforced by elastic reinforcements which are embedded in said element and extend from said upper edge of said element to the lower portion thereof.

2. The snow removal bar in accordance with claim 1, wherein said elastic reinforcements comprise stationarily-affixed helical springs.

3. The snow removal bar in accordance with claim 1 or 2, wherein hard material elements are embedded in the lower portion of said element in the area between said steel plates.

4. The snow removal bar in accordance with claim 3, wherein said hard material elements are made of metal.

5. The snow removal bar in accordance with claim 3, wherein said hard material elements are made of corundum.

6. The snow removal bar in accordance with claim 1, wherein a recess is provided in the upper edge of said snow removal bar for receiving the lower edge of said snow removal plate, and on the opposite side thereof, a support plate is provided for supporting coupling means.

* * * * *